US011680703B1

(12) United States Patent
Harris et al.

(10) Patent No.: US 11,680,703 B1
(45) Date of Patent: Jun. 20, 2023

(54) INSTALLATION STRUCTURE OF CEILING FAN AND UPPER ILLUMINATING LAMP

(71) Applicant: AIR COOL INDUSTRIAL CO., LTD.

(72) Inventors: Joseph Warren Harris, Canton, GA (US); Tim Liu, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 17/810,987

(22) Filed: Jul. 6, 2022

(51) Int. Cl.
*F21V 33/00* (2006.01)
*F04D 25/08* (2006.01)
*F21Y 103/33* (2016.01)

(52) U.S. Cl.
CPC ..... *F21V 33/0096* (2013.01); *F04D 25/088* (2013.01); *F21Y 2103/33* (2016.08)

(58) Field of Classification Search
CPC ..... F21V 33/096; F21V 29/67; F21V 21/096; F21Y 2103/33; F04D 25/088; A61L 2209/12
See application file for complete search history.

(56) References Cited

U.S. PATENT DOCUMENTS 8,033,787 B1 * 10/2011 Miller ..... F04D 25/088 416/5
11,236,753 B1 * 2/2022 Campbell ..... F21V 33/0096 362/96
2005/0147494 A1 * 7/2005 Hoshino ..... F04D 25/088 416/5
2020/0173446 A1 * 6/2020 Horng ..... F21V 33/0096 362/96
2022/0252252 A1 * 8/2022 Wang ..... F21S 8/036 362/96

* cited by examiner

*Primary Examiner* — Y M. Quach Lee
(74) *Attorney, Agent, or Firm* — Sinorica International Patent and Trademark

(57) ABSTRACT

An installation structure of a ceiling fan and an upper illuminating lamp includes a first mounting unit that is disposed on one of a connecting portion of a ceiling fan body and a lamp unit and a second mounting unit that is disposed on the other one of the connecting portion and the lamp unit. The second mounting unit corresponds to the first mounting unit. The first mounting unit and the second mounting unit are connected to each other so that the lamp unit and the ceiling fan body are coupled together, so as to complete the assembly quickly.

1 Claim, 9 Drawing Sheets

INSTALLATION STRUCTURE OF CEILING FAN AND UPPER ILLUMINATING LAMP

FIELD OF THE INVENTION

The present invention relates to a ceiling fan, and more particularly to an installation structure of a ceiling fan and an upper illuminating lamp.

BACKGROUND OF THE INVENTION

In general, a conventional ceiling fan has a ceiling fan body. A lamp is provided on the top of the ceiling fan body. The lamp is locked to the ceiling fan body by screws that are inserted downward from the top of the lamp to the ceiling fan body. When the ceiling fan is installed to the ceiling and it is required to disassemble, readjust and repair the lamp, the disassembly and assembly of the lamp becomes a difficult and dangerous work.

Accordingly, the inventor of the present invention has devoted himself based on his many years of practical experiences to solve these problems.

SUMMARY OF THE INVENTION

The primary object of the present invention is to provide an installation structure of a ceiling fan and an upper illuminating lamp, which can achieve quick assembly and disassembly to increase the convenience in use.

In order to achieve the above object, the present invention provides an installation structure of a ceiling fan and an upper illuminating lamp, comprising a ceiling fan body, a down rod, a lamp unit, a first mounting unit, and a second mounting unit. The ceiling fan body has a connecting portion on its upper side. The down rod is connected to the upper side of the ceiling fan body. The lamp unit is disposed above the ceiling fan body. The lamp unit includes at least one lamp. The lamp of the lamp unit is disposed on an outer side of the down rod. The lamp has a light-emitting portion on its upper side. The light-emitting portion illuminates upwards. The first mounting unit is disposed on one of the connecting portion and the lamp of the lamp unit. The second mounting unit is disposed on the other one of the connecting portion and the lamp of the lamp unit. The second mounting unit corresponds to the first mounting unit.

In the installation structure of the ceiling fan and the upper illuminating lamp provided by the present invention provides, the first mounting unit and the second mounting unit are connected to each other so that the lamp of the lamp unit and the ceiling fan body are coupled together.

DETAILED DESCRIPTION OF THE PREFERRED EMBODIMENTS

Figure 1:
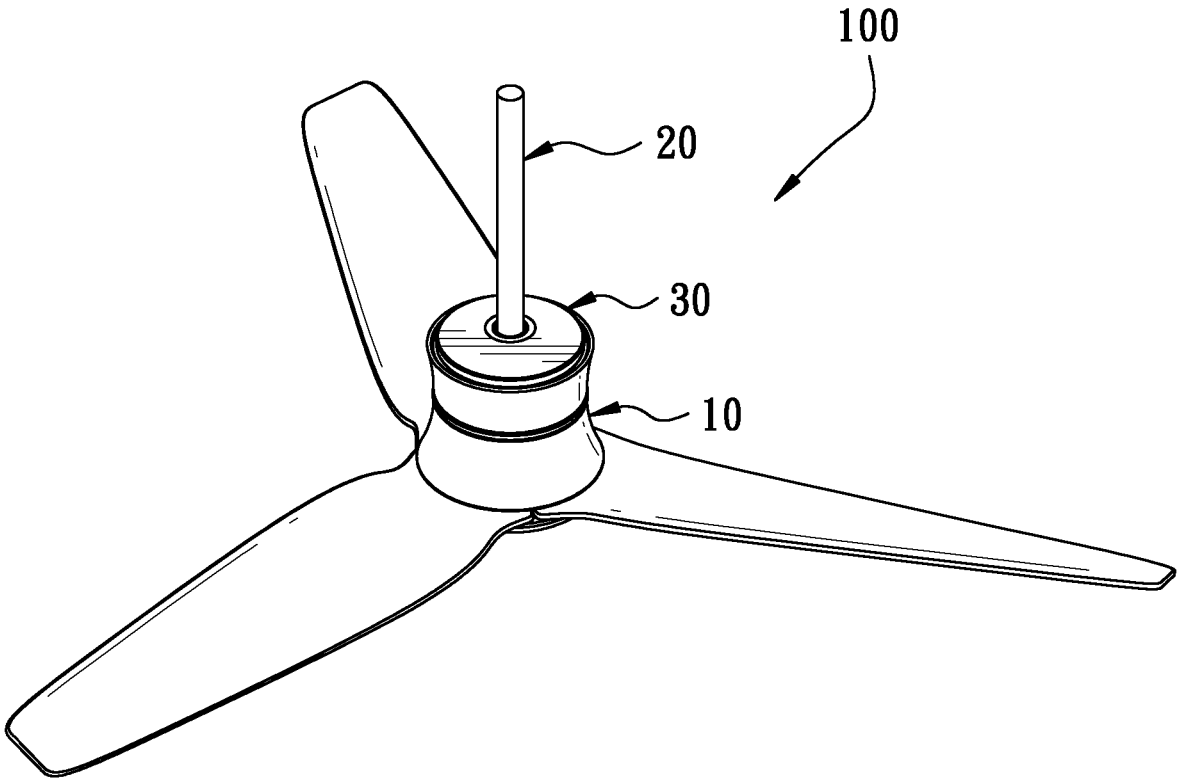
FIG. 1 is a perspective view in accordance with a first embodiment of the present invention.
Figure 2:
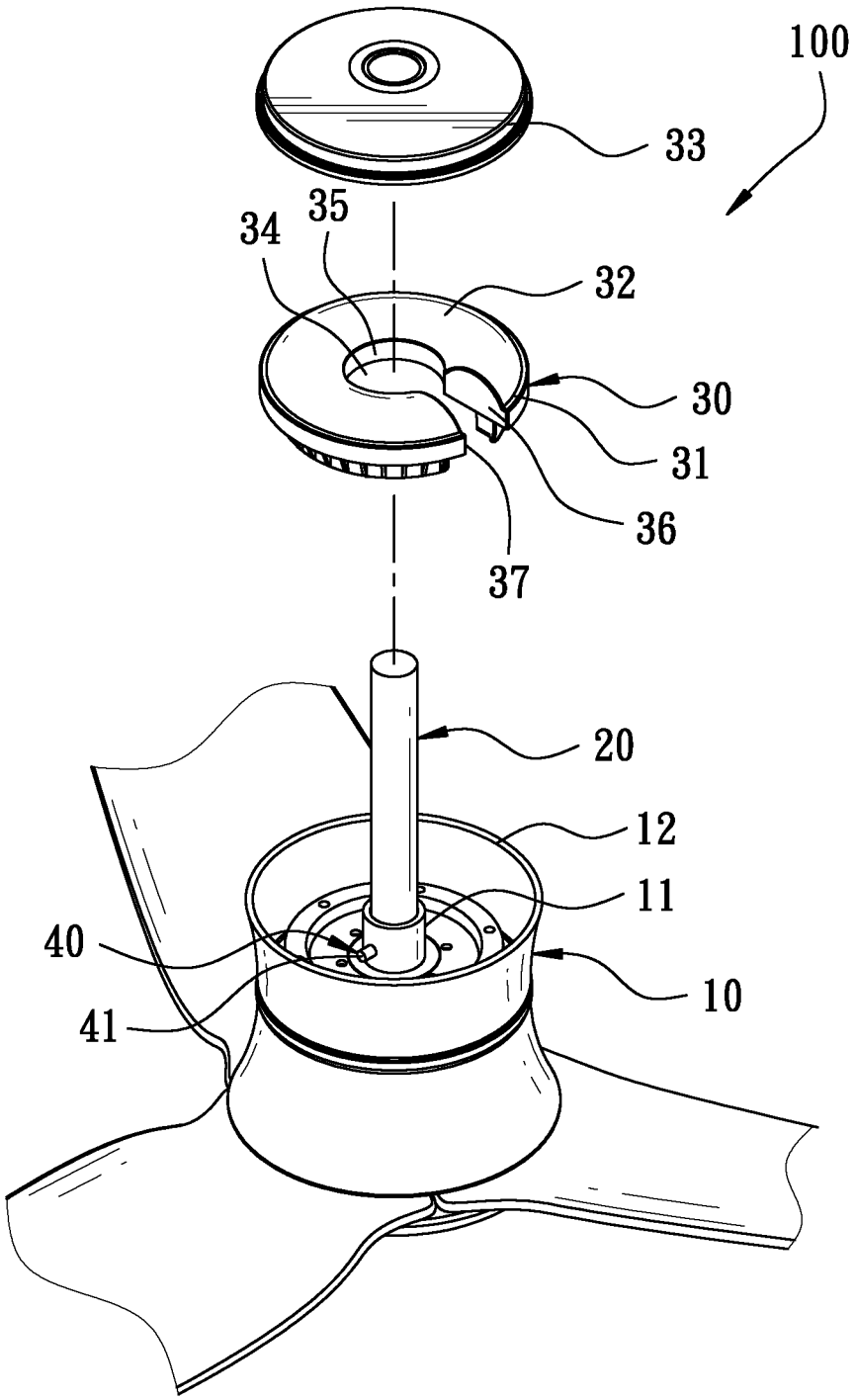
FIG. 2 is an exploded view in accordance with the first embodiment of the present invention.
Figure 3:
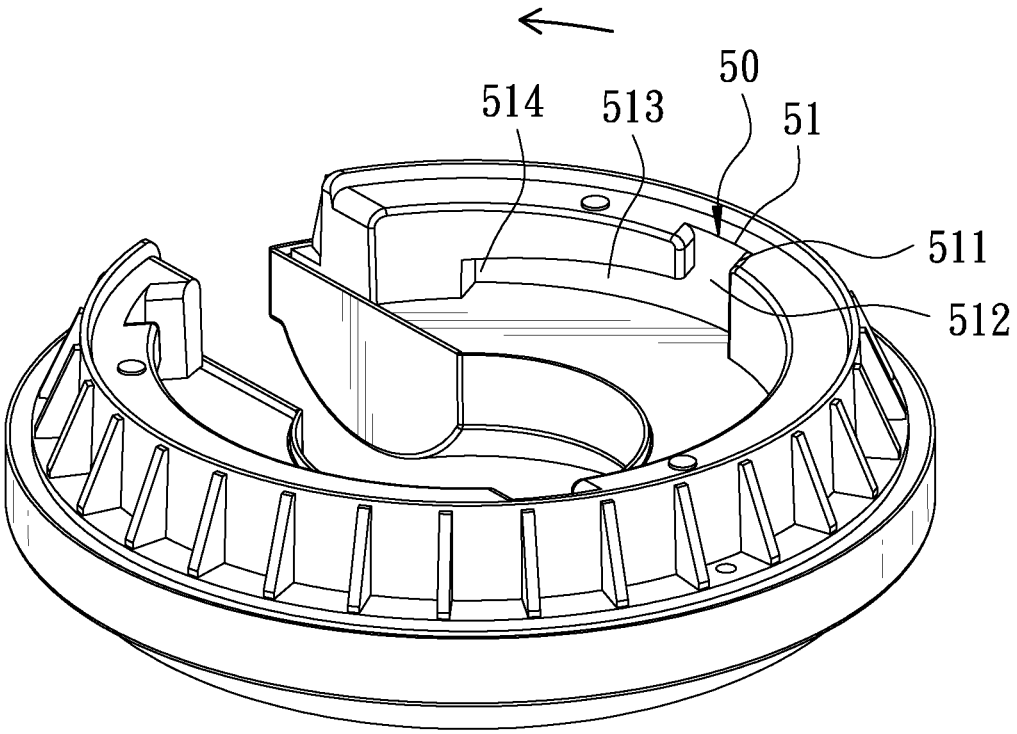
FIG. 3 is a schematic view of the first embodiment of the present invention, illustrating the lamp and the second mounting unit.
Figure 4:
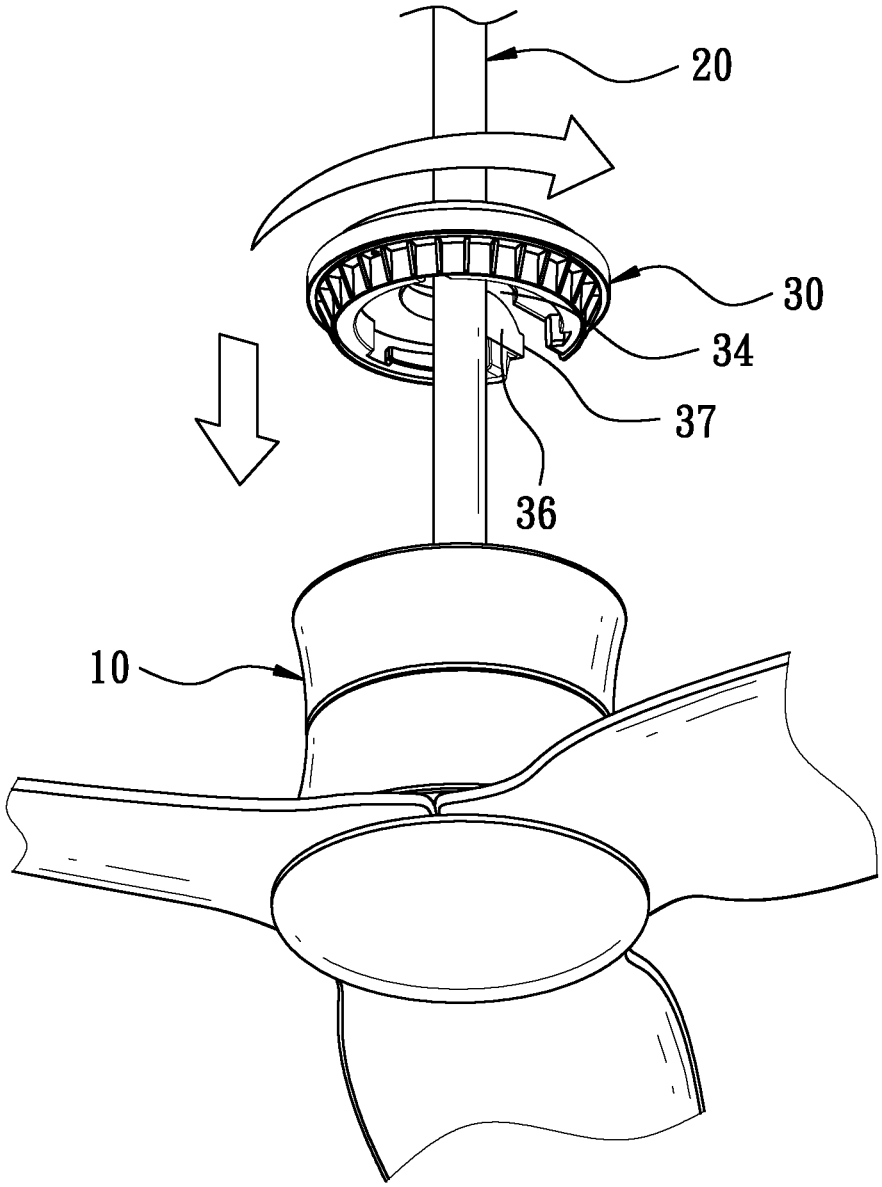
FIG. 4 is a schematic view of the first embodiment of the present invention when in use, illustrating that the lamp is to be installed to the ceiling fan body.

Embodiments of the present invention will now be described, by way of example only, with reference to the accompanying drawings.

Referring to FIG. 1 through FIG. 4, an installation structure 100 of a ceiling fan and an upper illuminating lamp according to a first embodiment of the present invention comprises a ceiling fan body 10, a down rod 20, a lamp unit 30, a first mounting unit 40, and a second mounting unit 50.

The ceiling fan body 10 has a connecting portion 11 on its upper side. The ceiling fan body 10 further has a peripheral wall 12.

The down rod 20 is connected to the upper side of the ceiling fan body 10. In the first embodiment of the present invention, the down rod 20 is connected to the inside of the connecting portion 11.

The lamp unit 30 is disposed above the ceiling fan body 10. The lamp unit 30 is disposed within the peripheral wall 12 of the ceiling fan body 10 to prevent the lamp from falling off because of looseness. The lamp unit 30 includes at least one lamp 31. In the first embodiment of the present invention, the number of the at least one lamp 31 is one. The lamp 31 of the lamp unit 30 is disposed on the outer side of the down rod 20. The lamp 31 has a light-emitting portion 32 on its upper side. The light-emitting portion 32 illuminates upwards. A lampshade 33 is disposed on the outer side of the light-emitting portion 32 of the lamp 31 of the lamp unit 30. The lamp unit 30 has a longitudinal through space 34 corresponding to the down rod 20. The down rod 20 is inserted through the through space 34. The inner side of the lamp 31 has a longitudinal inner arc surface 35 corresponding to the down rod 20. The inner arc surface 35 of the lamp 31 of the lamp unit 30 surrounds the through space 34. The lamp 31 has a pair of longitudinal side wall surfaces 36 on its both sides. An opening 37 is defined between the pair of side wall surfaces 36 of the lamp 31. The opening 37 communicates with the through space 34. The opening 37 is configured to allow the down rod 20 to pass through.

The first mounting unit 40 is disposed on one of the connecting portion 11 and the lamp 31 of the lamp unit 30. In the first embodiment of the present invention, the first mounting unit 40 is disposed around the outer wall of the connecting portion 11. The first mounting unit 40 includes at least two protruding posts 41. The protruding posts 41 are spaced apart from each other and extend radially.

The second mounting unit 50 is disposed on the other one of the connecting portion 11 and the lamp 31 of the lamp unit 30. In the first embodiment of the present invention, the second mounting unit 50 is disposed around the inner wall of the lamp unit 30. The second mounting unit 50 corresponds to the first mounting unit 40. The second mounting unit 50 includes a plurality of guide structures 51. The guide structures 51 correspond to the protruding posts 41. The guide structures 51 each include a notch 511, a groove 512 and a guide groove 513 corresponding to the protruding posts 41. The groove 512 extends longitudinally. The notch 511 is located at one side of the groove 512 for the corresponding protruding post 41 to be located and inserted therefrom. The guide groove 513 extends from the other side of the groove 512 toward a pressing end 514 along a guide direction and a radial direction. The guide groove 513 is gradually reduced toward the pressing end 514 for guiding and tightening the corresponding protruding post 41.

In installation, the down rod 20 passes through the opening 37 and the through space 34 of the lamp unit 30. The protruding post 41 of the connecting portion 11 of the first mounting unit 40 of the ceiling fan body 10 passes through the notch 511 and the groove 512 to be inserted into the guide groove 513 of the guide structure 51 of the second mounting unit 50 of the lamp unit 30. The pressing end 514 of the guide groove 513 presses against the protruding post 41, so that the ceiling fan body 10 and the lamp unit 30 are coupled together to complete the assembly quickly.

In the first embodiment of the present invention, there are many connection implementations. Therefore, the details are not repeated here, and only one preferred implementation is listed for specific description.

Figure 5:
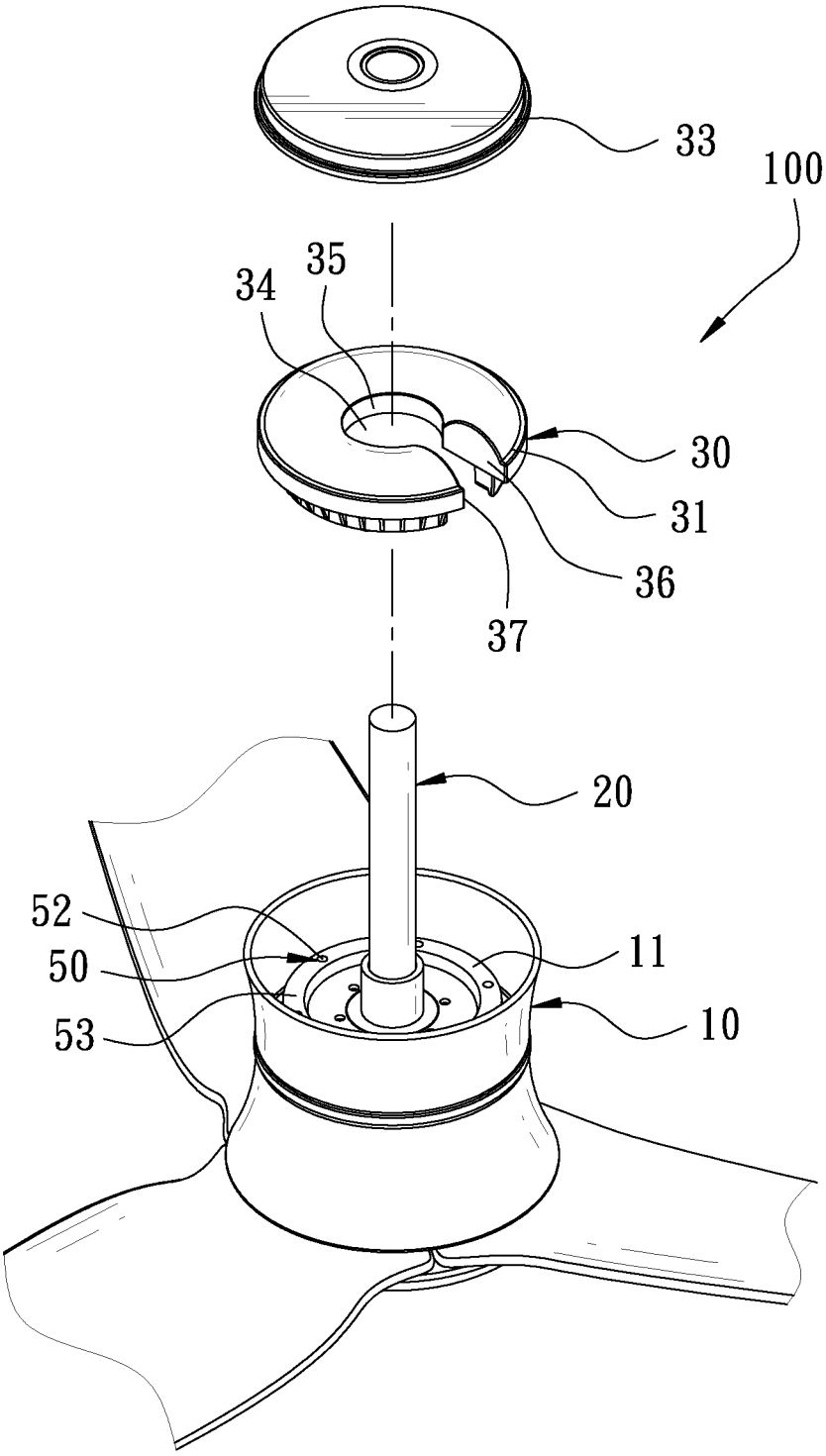
FIG. 5 is an exploded view in accordance with a second embodiment of the present invention.
Figure 6:
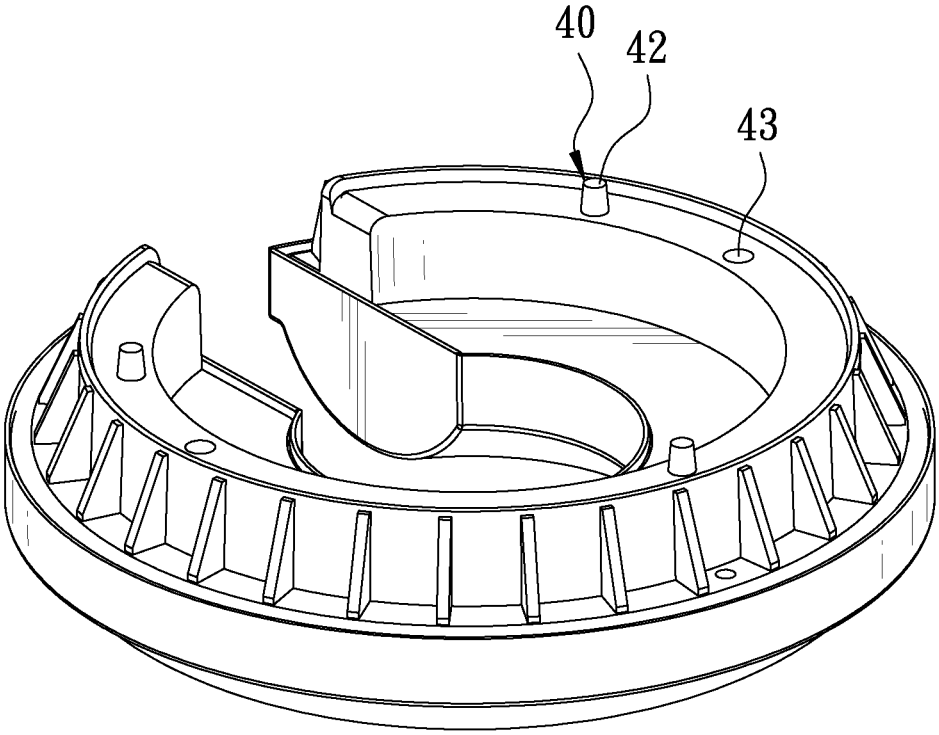
FIG. 6 is a schematic view of the second embodiment of the present invention, illustrating the lamp and the first mounting unit.
Figure 7:
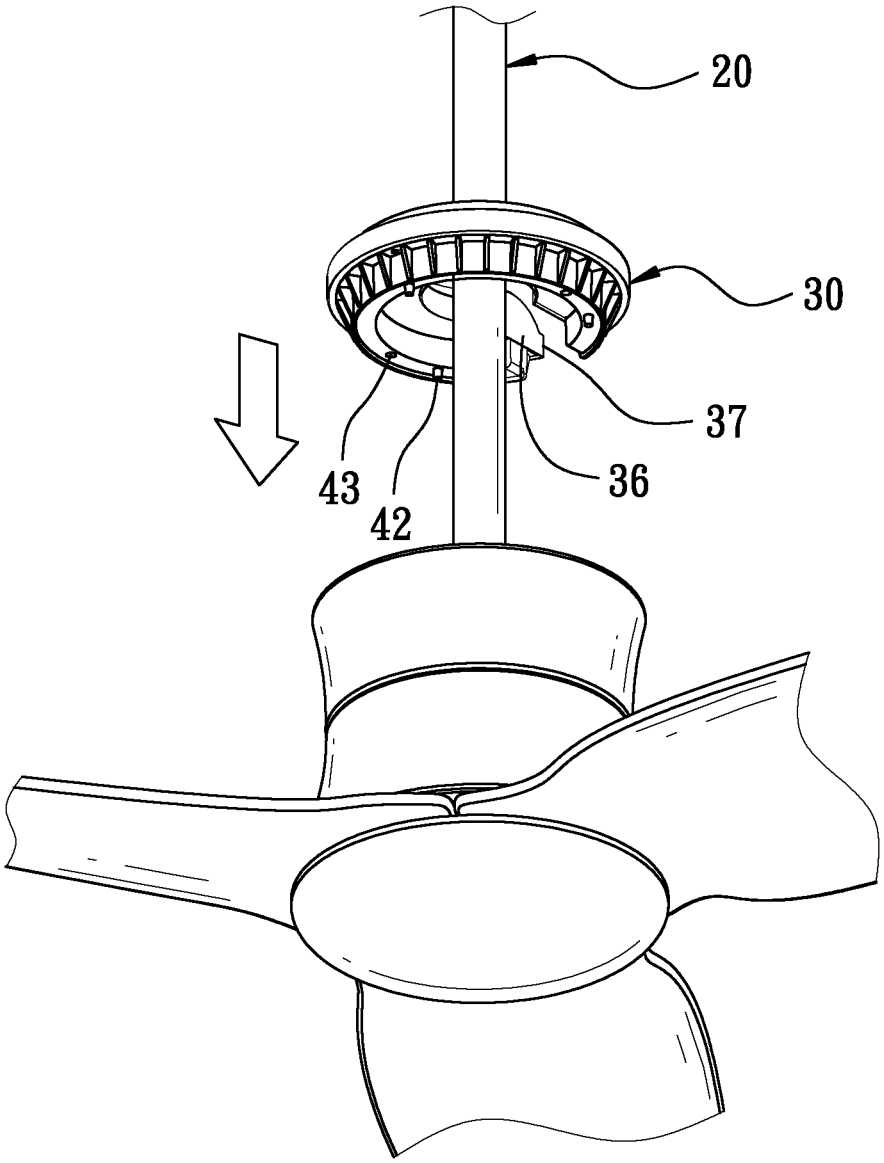
FIG. 7 is a schematic view of the second embodiment of the present invention when in use, illustrating that the lamp is to be installed to the ceiling fan body.

FIGS. 5 to 7 illustrate a second embodiment of the present invention. The second embodiment of the present invention is substantially similar to the first embodiment with the exceptions described hereinafter.

The connecting portion 11 is disposed on the outer side of the top of the ceiling fan body 10. The number of the at least one lamp 31 is one.

The first mounting unit 40 includes a plurality of positioning posts 42 and at least one first magnetic portion 43. The positioning posts 42 extend longitudinally. In the second embodiment of the present invention, the first mounting unit 40 is disposed around the lamp unit 30.

The second mounting unit 50 includes a plurality of positioning grooves 52 and at least one second magnetic portion 53. The positioning grooves 52 correspond to the positioning posts 42. The positioning grooves 52 extend longitudinally for insertion of the positioning posts 42. The at least one second magnetic portion 53 corresponds to and attracts the at least one first magnetic portion 43. In the second embodiment of the present invention, the second mounting unit 50 is disposed around the connecting portion 11.

In installation, the down rod 20 passes through the opening 37 and the through space 34 of the lamp unit 30. The positioning posts 42 of the first mounting unit 40 of the lamp unit 30 are inserted into the positioning grooves 52 of the second mounting unit 50 of the ceiling fan body 10. The first magnetic portion 43 of the first mounting unit 40 of the lamp unit 30 attracts the second magnetic portion 53 of the second mounting unit 50 of the ceiling fan body 10, so that the ceiling fan body 10 and the lamp 31 of the lamp unit 30 are coupled together to complete the assembly quickly.

In the second embodiment of the present invention, there are many connection implementations. Therefore, the details are not repeated here, and only one preferred implementation is listed for specific description.

Figure 8:
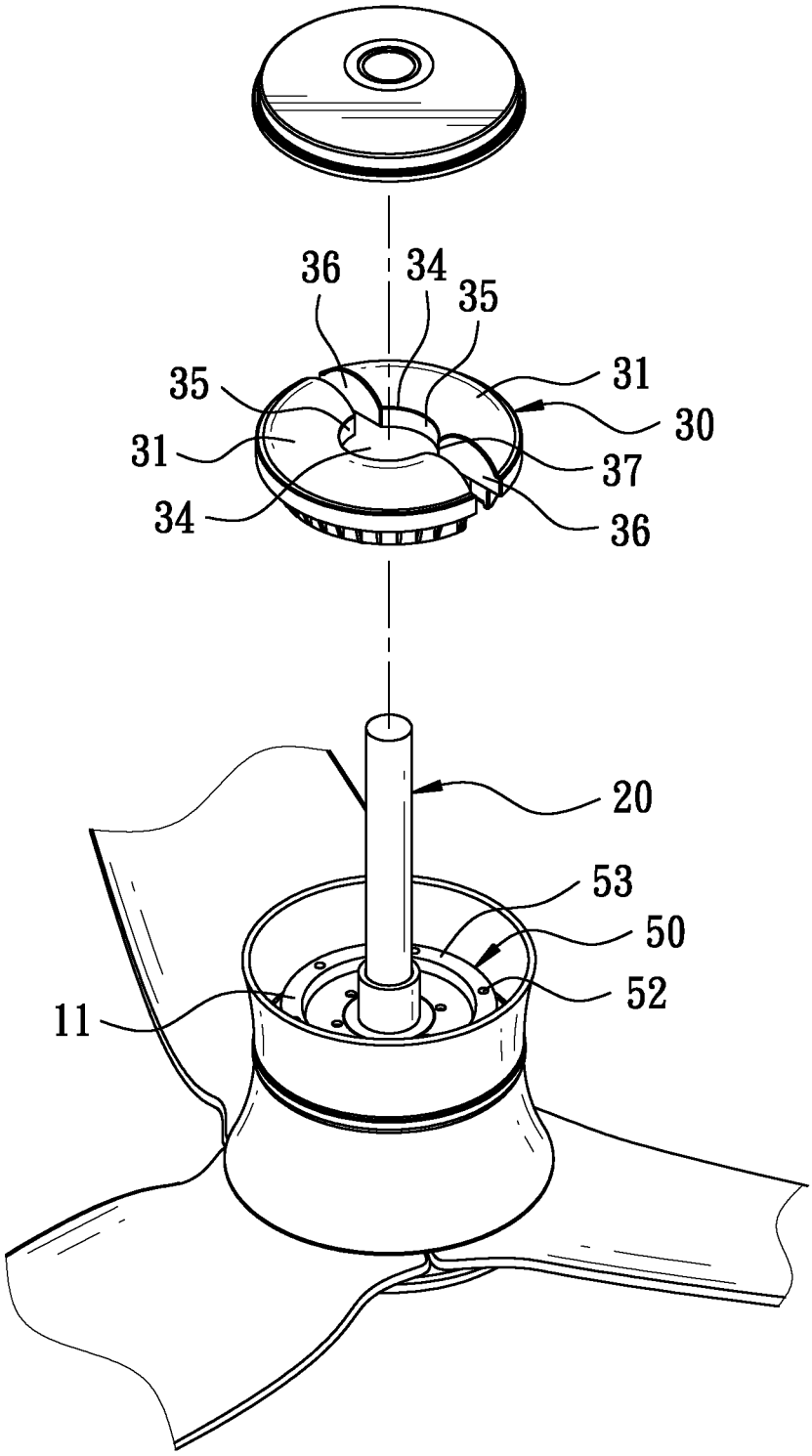
FIG. 8 is an exploded view in accordance with a third embodiment of the present invention, wherein the lamp unit includes a plurality of lamps.
Figure 9:
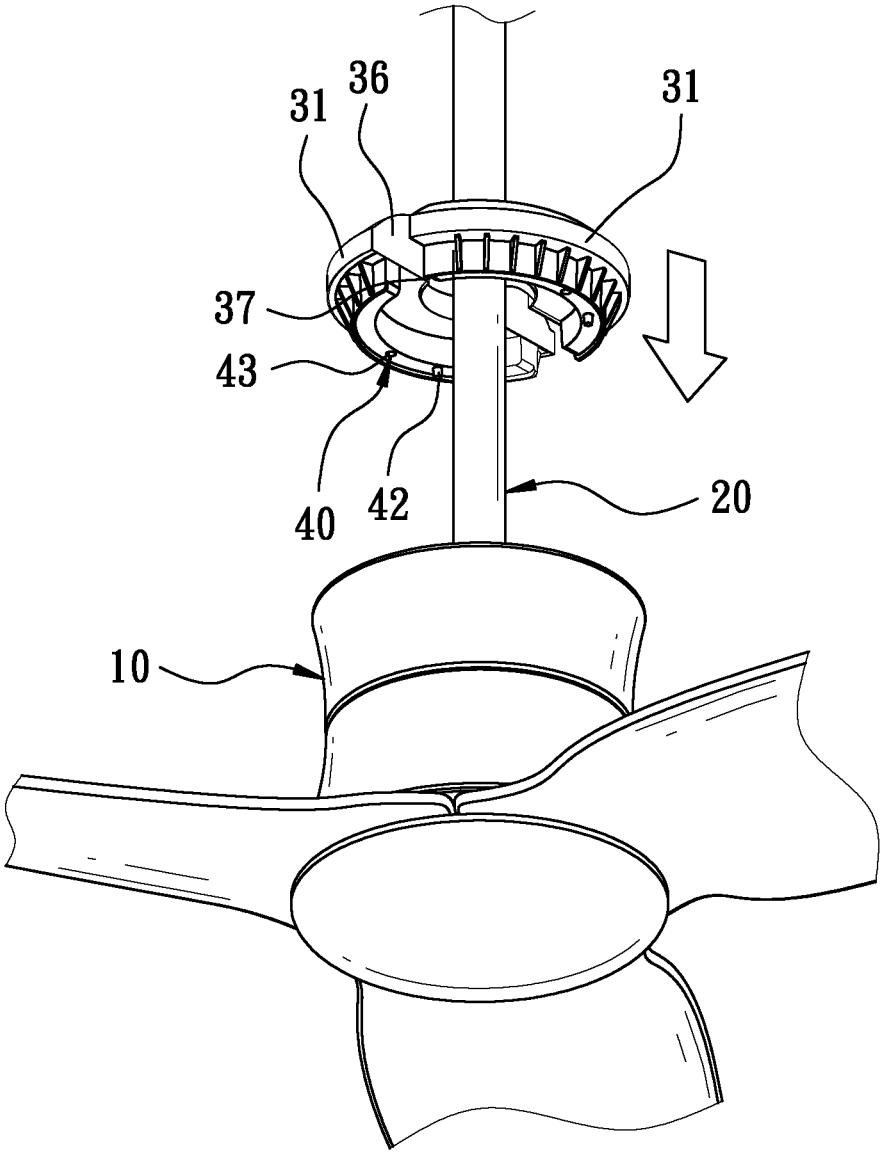
FIG. 9 is a schematic view of the third embodiment of the present invention when in use, illustrating that the lamps are to be installed to the ceiling fan body.

FIGS. 8 to 9 illustrate a third embodiment of the present invention. The third embodiment of the present invention is substantially similar to the second embodiment with the exceptions described hereinafter. The at least one lamp 31 includes a plurality of lamps. The at least one first magnetic portion 43 includes a plurality of first magnetic portions. The positioning posts 42 and the first magnetic portions 43 of the first mounting portion 40 are disposed on one of the connecting portion 11 and each lamp 31 of the lamp unit 30. The positioning grooves 52 and the second magnetic portions 53 of the second mounting portion 50 are disposed on the other one of the connecting portion 11 and each lamp 31 of the lamp unit 30. When the lamps 31 are to be assembled and disassembled, the opening 37 defined between the side wall surfaces 36 of the lamp 31 allows the displacement of the down rod 20, thereby increasing the convenience of use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An installation structure of a ceiling fan and an upper illuminating lamp, comprising:

a ceiling fan body, having a connecting portion on its upper side;

a down rod, connected to the upper side of the ceiling fan body;

a lamp unit, disposed above the ceiling fan body, the lamp unit including at least one lamp, the lamp of the lamp unit being disposed on an outer side of the down rod, the lamp having a light-emitting portion on its upper side, the light-emitting portion illuminating upwards;

a first mounting unit, disposed on one of the connecting portion and the lamp of the lamp unit;

a second mounting unit, disposed on the other one of the connecting portion and the lamp of the lamp unit, the second mounting unit corresponding to the first mounting unit, the first mounting unit and the second mounting unit are connected to each other so that the lamp of the lamp unit and the ceiling fan body are coupled together;

the first mounting unit includes at least two protruding posts, the protruding posts are spaced apart from each other and extend radially, the second mounting unit includes a plurality of guide structures, the guide structures correspond to the protruding posts, the guide structures each include a notch, a groove and a guide groove corresponding to the protruding posts, the groove extends longitudinally, the notch is located at one side of the groove for a corresponding one of the protruding posts to be located and inserted therefrom, the guide groove extends from another side of the groove toward a pressing end along a guide direction and a radial direction, and the guide groove is gradually reduced toward the pressing end for guiding and tightening the corresponding protruding post;

the number of the at least one lamp is one; and the down rod is connected to an inside of the connecting portion, a lampshade is disposed on an outer side of the lamp of the lamp unit, the lamp unit has a longitudinal through space corresponding to the down rod, the down rod is inserted through the through space, an inner side of the lamp has a longitudinal inner arc surface corresponding to the down rod, the inner arc surface of the lamp of the lamp unit surrounds the through space, the lamp has a pair of longitudinal side wall surfaces on its both sides, an opening is defined between the pair of side wall surfaces of the lamp, the opening communicates with the through space, the opening is configured to allow the down rod to pass through, the ceiling fan body further has a peripheral wall, and the lamp unit is disposed within the peripheral wall of the ceiling fan body.

* * * * *